US005902187A

United States Patent [19]

Boring

[11] Patent Number: 5,902,187

[45] Date of Patent: May 11, 1999

[54] PORTABLE LAWN SWING

[76] Inventor: Gary Boring, 1434 Bleistein Ave., Cody, Wyo. 82414

[21] Appl. No.: 09/058,009

[22] Filed: Apr. 9, 1998

[51] Int. Cl.[6] ..... A63G 9/62

[52] U.S. Cl. ..... 472/125; 472/118; 297/77; 297/245

[58] Field of Search ..... 472/118, 119, 472/120, 121, 122, 123, 124, 125; 297/157.1, 158.1, 158.2, 245, 273, 77

[56] References Cited

U.S. PATENT DOCUMENTS

| | | | |
|---|---|---|---|
| 141,676 | 8/1873 | Cosme . | |
| 497,258 | 5/1893 | Wilcox . | |
| 531,472 | 12/1894 | Shorey . | |
| 678,336 | 7/1901 | Gagnon | 472/125 |
| 682,672 | 9/1901 | Cotner . | |
| 686,420 | 11/1901 | Powell | 297/245 |
| 715,668 | 12/1902 | Kiddie | 297/245 |
| 736,822 | 8/1903 | Cotner . | |
| 769,299 | 9/1904 | Boyer . | |
| 862,686 | 8/1907 | Wallace . | |
| 1,128,709 | 2/1915 | Miesner . | |
| 1,156,189 | 10/1915 | Stohler | 297/245 |
| 1,196,375 | 8/1916 | Medart | 297/245 |
| 1,215,110 | 2/1917 | Carey . | |

*Primary Examiner*—Kien T. Nguyen
*Attorney, Agent, or Firm*—Michael S. Neustel

[57] ABSTRACT

A portable lawn swing which has a relatively stable frame of a simple construction and lightweight for transportability purposes. The inventive device includes an X-member, four base members attached to the ends of the X-member, four legs attached to the base members, a plurality of support members pivotally attached to an upper portion of the legs which support a pair of seats, a pair of screens attached below the pair of seats, a plurality of cup holders, and at least one bar pivotally attached to a leg which is selectively engageable to a support member for preventing movement of the pair of seats. The X-member comprises a pair of U-shaped members centrally attached to one another forming an X-shape. The pair of U-shaped members retain the legs in the desired position thereby preventing them from moving during use of the invention.

11 Claims, 4 Drawing Sheets

PORTABLE LAWN SWING

BACKGROUND OF THE INVENTION

1. Field of the Invention

The present invention relates generally to portable lawn swings and more specifically it relates to a portable lawn swing which has a relatively stable frame which is of a simple construction and lightweight for transportability purposes.

A common problem with conventional lawn swings is the frames require the use of a plurality of cross-members on the lower support structure to maintain stability during operation. Another common problem with conventional lawn swings is the user's legs will sometimes become lodged between the lower portion of the swing and the ground. Another problem with conventional lawn swings is that when moving the lawn swing to a different location in the user's yard, the chair portion of the lawn swing will move about uncontrollably. Hence, there is a need to overcome the shortcomings in the prior art lawn swings.

2. Description of the Prior Art

There are numerous portable lawn swing devices. For example, U.S. Pat. No. 686,420 to Powell; U.S. Pat. No. 1,215,110 to Carey; U.S. Pat. No. 497,258 to Wilcox; U.S. Pat. No. 141,676 to Cosme; U.S. Pat. No. 531,472 to Shorey; U.S. Pat. No. 678,336 to Gagnon; U.S. Pat. No. 682,672 to Cotner; U.S. Pat. No. 715,668 to Kiddie; U.S. Pat. No. 736,822 to Cotner; U.S. Pat. No. 769,299 to Boyer; U.S. Pat. No. 862,686 to Wallace; U.S. Pat. No. 1,128,709 to Miesner; U.S. Pat. No. 1,156,189 to Stohler; U.S. Pat. No. 1,196,375 to Medartall are illustrative of such prior art.

Powell (U.S. Pat. No. 686,420) discloses a combined swinging chair and crib. Powell discloses a frame pivotally supporting a pair of chairs. The frame of Powell comprises a pair of lower cross-members attached to four legs. An additional pair of end members are attached to a respective pair of the four legs to prevent rotation of the pair of lower cross-members with respect to each other. Powell does not disclose a lower frame structure which does not require the use of a pair of end members to prevent rotation of the pair of cross-members as taught by the present invention. Powell further does not disclose a means for preventing the user's legs from becoming entangled between the swing and the ground as taught by the present invention. Further, Powell does not disclose a means for preventing pivoting of the swing during relocation as taught by the present invention.

Carey (U.S. Pat. No. 1,215,110) discloses a swing pivotally attached to an axle between a pair of permanently mounted poles. Carey does not disclose a portable lawn swing as taught by the present invention.

While these devices may be suitable for the particular purpose to which they address, they do not have a relatively stable frame which is of a simple construction and lightweight for transportability purposes. The prior art is either constructed of a complex structure or does not prevent the user's legs from becoming entangled between the swing and the ground. Further, the prior art does not disclose a means for preventing pivoting of the swing during relocation of the lawn swing.

In these respects, the portable lawn swing according to the present invention substantially departs from the conventional concepts and designs of the prior art, and in so doing provides an apparatus which has a relatively stable frame of a relatively simple construction and lightweight for transportability purposes.

SUMMARY OF THE INVENTION

A primary object of the present invention is to provide a portable lawn swing that will overcome the shortcomings of the prior art devices.

Another object is to provide a portable lawn swing that is of a simple construction and lightweight for allowing easy relocation thereof.

An additional object is to provide a portable lawn swing that provides a means for locking the swing from moving.

A further object is to provide a portable lawn swing that decreases the probability that a user's legs will become entangled between the swing and the ground.

Another object is to provide a portable lawn swing that has legs which do not separate when positioned upon relatively slippery surfaces such as concrete or asphalt.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
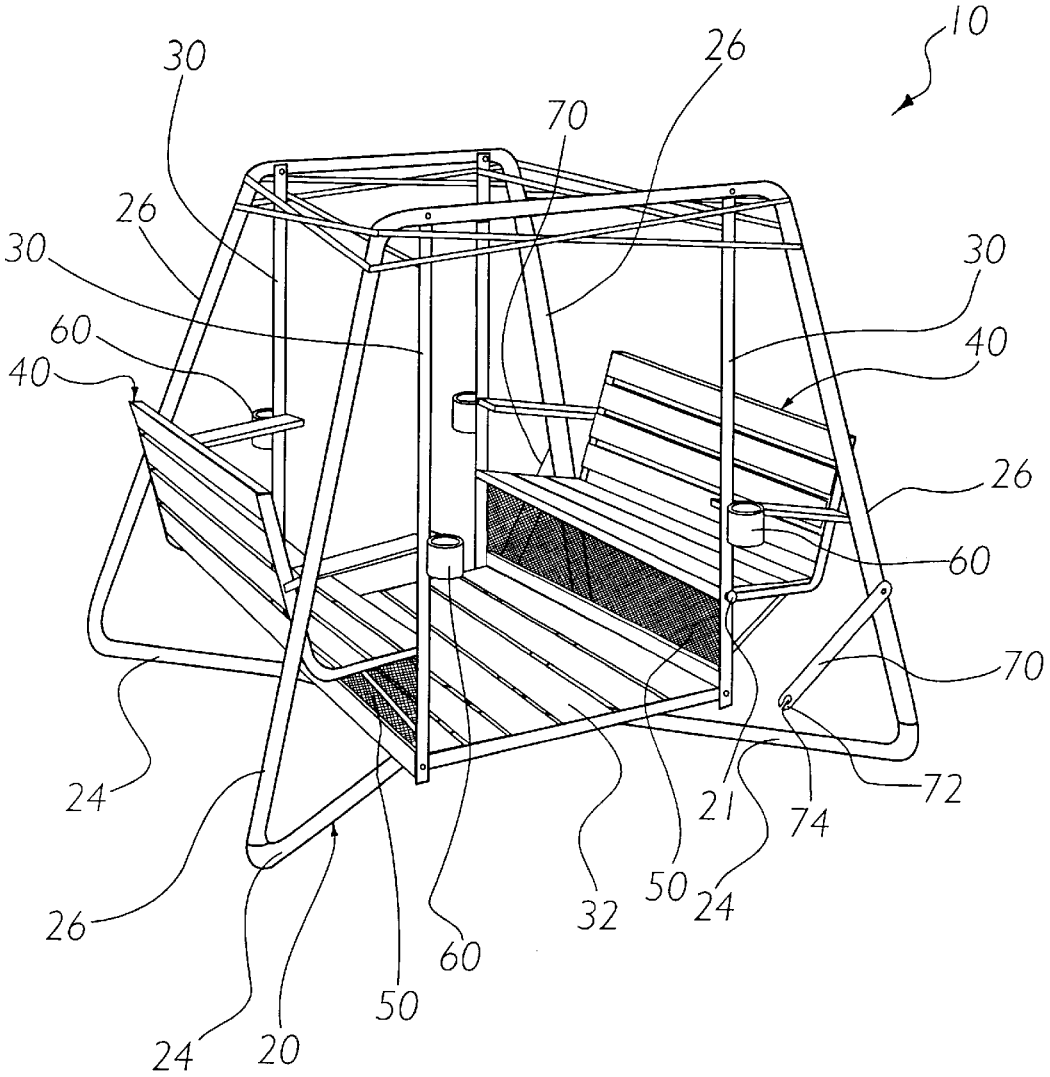
FIG. 1 is an upper perspective view of the present invention.

Turning now descriptively to the drawings, in which similar reference characters denote similar elements throughout the several view, FIGS. 1 through 4 illustrate a portable lawn swing 10, which comprises an X-member 22, four base members 24 attached to the ends of the X-member 22, four legs 26 attached to the base members 24, a plurality of support members 30 pivotally attached to an upper portion of the legs 26 which support a pair of seats 40, a pair of screens 50 attached below the pair of seats 40, a plurality of cup holders 60, and at least one bar 70 pivotally attached to a leg 26 which is selectively engageable to a support member 30 for preventing movement of the pair of seats 40. The X-member 22 comprises a pair of U-shaped members centrally attached to one another forming an X-shape. The pair of U-shaped members retain the legs 26 in the desired position thereby preventing them from moving during use of the invention even when placed upon relatively slippery surfaces.

Figure 3:
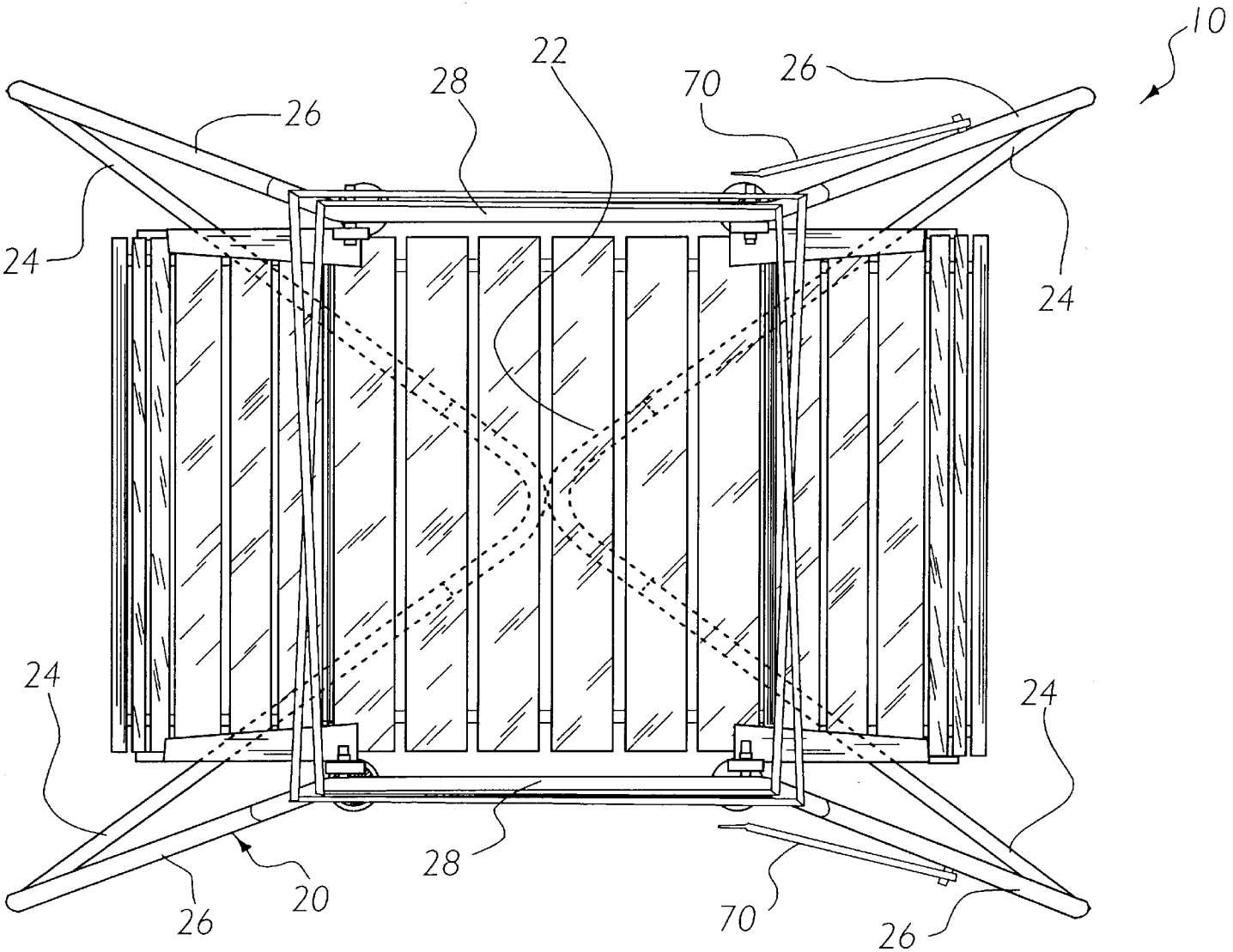
FIG. 3 is a top view of the present invention.
Figure 4:
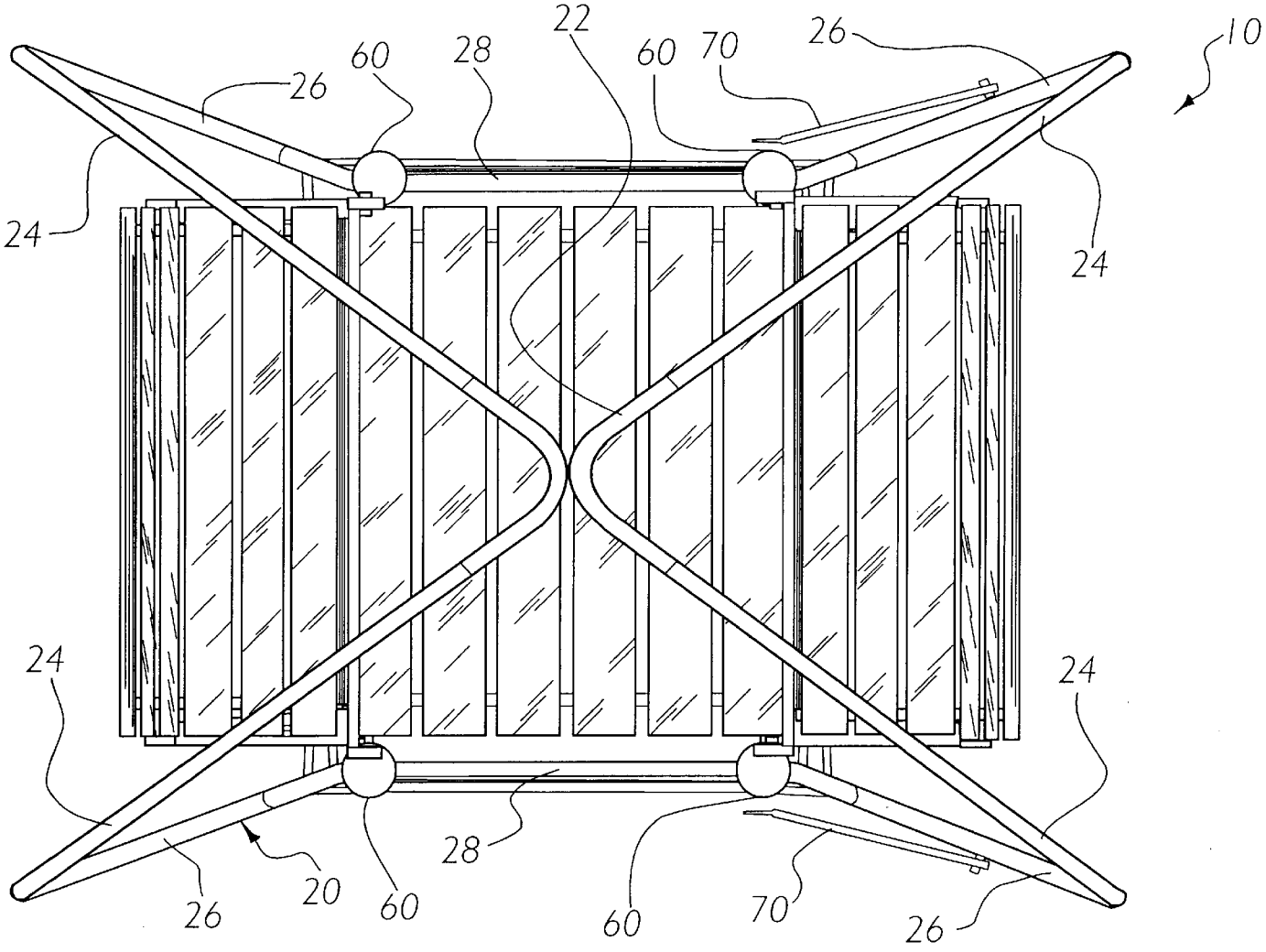
FIG. 4 is a bottom view of the present invention.

As shown in FIG. 1 of the drawings, the present invention includes a support frame 20 pivotally supporting a pair of seats 40. As shown in FIGS. 3 and 4, the support frame 20 comprises an X-member 22, four base members 24, four legs 26, a two upper members 28 and four sets of cross members 29 attached together by a plurality of fasteners 21.

As best shown in FIGS. 3 and 4 of the drawings, the X-member 22 comprises a pair of U-shaped members attached to one another. The X-member 22 is preferably constructed of a conventional material such as metal or plastic. As best shown in FIG. 4, the four base members 24 are attached to the distal ends of the X-member 22 and extend radially away from each other in an X-shape. The distal ends of the four base members 24 are curved upwardly and inwardly as best shown in FIG. 1 of the drawings.

Figure 2:
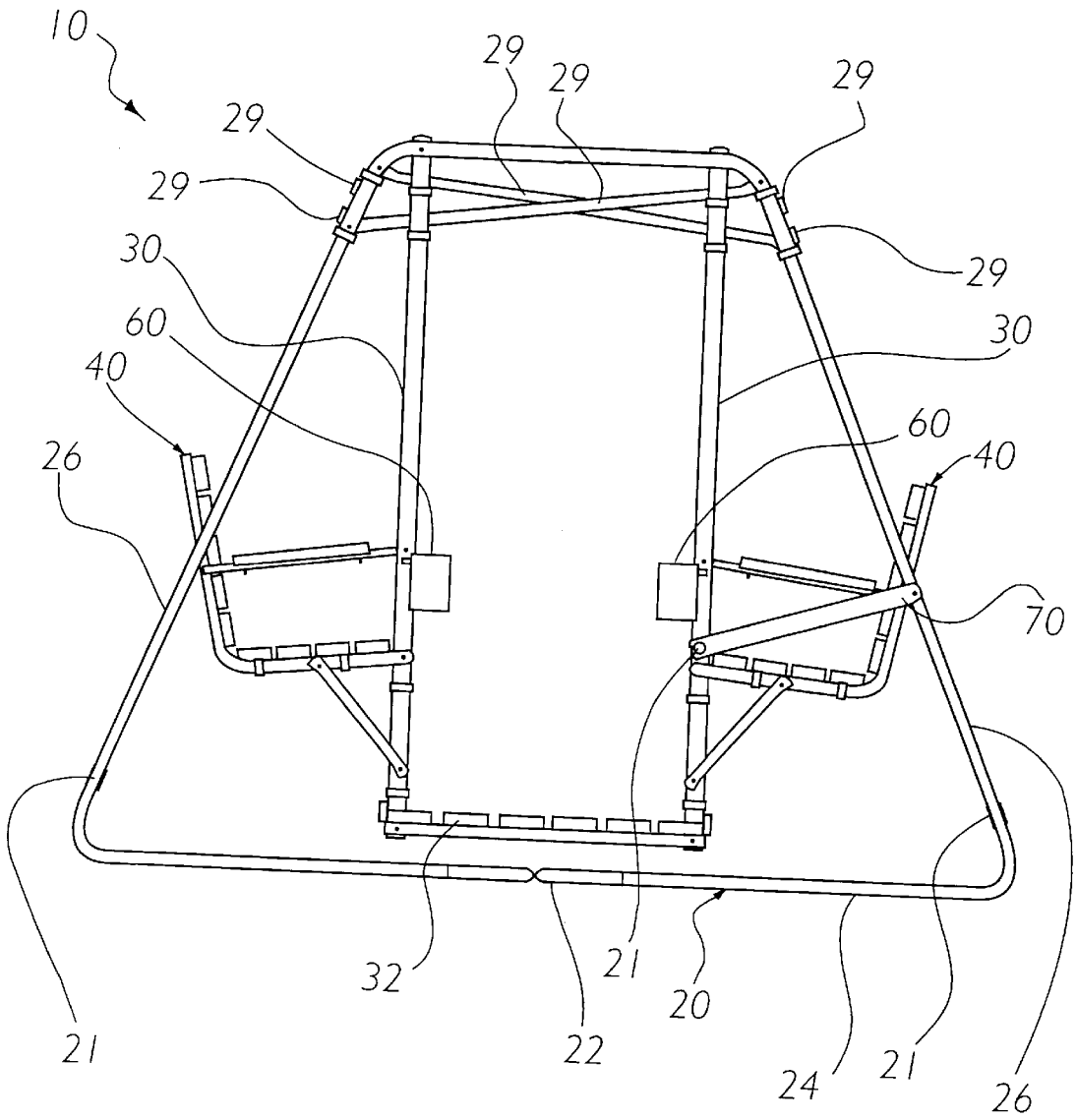
FIG. 2 is a side view of the present invention.

As best shown in FIGS. 1 and 2 of the drawings, the four legs 26 are attached to the curved ends of the four corresponding base members 24 by a corresponding number of fasteners 21. The fasteners 21 may comprise a sleeve or conventional screws or bolts. A pair of upper members 28 are attached to opposing distal ends of the four legs 26 as best shown in FIGS. 1 and 3 of the drawings. A plurality of cross members 29 are attached to the upper portions of the legs 26 and upper members 28 for increasing stability of the upper portion of the support frame 20.

As shown in FIGS. 1 and 2 of the drawings, four support members 30 are pivotally attached to the upper members 28. A platform 32 is pivotally attached between the lower portion of the support members 30 as shown in FIG. 2 of the drawings. A pair of opposing seats 40 are attached to a corresponding pair of the support members 30 as best shown in FIG. 1 of the drawings. A plurality of cup holders 60 are attached to the sides of the support members 30 as shown in FIG. 1 of the drawings. As best shown in FIG. 1 of the drawings, a pair of opposing screens 50 are attached to the support members 30 below the corresponding seats 40 for preventing the user's feet and legs from becoming entangled between the ground and the platform 32. The screens 50 are preferably constructed of a reticulated mesh, but may comprise a plurality of elongated members or other similar structures.

As best shown in FIG. 2 of the drawings, a pair of bars 70 are pivotally attached to opposing legs 26. The distal ends of the pair of bars 70 includes an angled portion 72 toward the support members 30. The distal ends of the pair of bars 70 include an aperture 74 which has a key-hole shape. A pair of flanged end members 76 are attached to the sides of the support members 30 with the flanged end portion exposed. The aperture 74 is capable of selectively receiving the flanged end member as best shown in FIG. 2 of the drawings.

In use, the user locks the present invention by engaging the bars 70 with the flanged end members 76 as shown in FIG. 2 to prevent movement of the swing portion. The user thereafter positions the present invention in the desired location in which to swing. Thereafter, the user releases the bars 70 from the flanged end members 76 thereby allowing the seats 40 to freely swing about. The user sits within one of the seats 40 and manually manipulates the present invention so that the seats 40 pivot within the support frame 20. The screens 50 prevent the user's legs 26 from becoming entangled during use. Additionally, the shape of the X-member 22 prevents the four legs 26 from spreading apart in any direction. When the user is finished utilizing the present invention, the bars 70 are selectively engaged to the flanged end members 76 to prevent the wind or children from moving the swing portion.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable lawn swing comprising:

a support frame having a base, a plurality of legs and an upper portion;

a seat structure pivotally attached to said upper portion of said support frame for supporting a user;

wherein said base comprises an X-member with a plurality of base members extending from the distal ends of said X-member; and wherein said X-member comprises a pair of U-shaped members attached at their relative vertexes.

2. The portable lawn swing of claim 1, wherein said seat structure includes a means for preventing leg injury to said user during use.

3. The portable lawn swing of claim 2, wherein said means for preventing leg injury comprises a screen.

4. The portable lawn swing of claim 3, wherein said screen is comprised of a reticulated mesh.

5. The portable lawn swing of claim 4, wherein said seat structure includes at least one cup holder for retaining drinks.

6. The portable lawn swing of claim 2, including:

at least one bar having a first end and a second end, said first end pivotally attached to one of said plurality of legs;

a flanged end member attached to said seat structure; and said second end of said at least one bar includes a tapered aperture which selectively captures said flanged end member for retaining said seat structure in a fixed position relative to said support frame.

7. The portable lawn swing of claim 6, wherein said second end of said at least one bar includes an angled portion so as to be substantially parallel to said seat structure.

8. The portable lawn swing of claim 7, wherein said seat structure includes a pair of seats.

9. The portable lawn swing of claim 8, wherein said at least one bar comprises a pair of bars on opposing sides of said seat structure.

10. The portable lawn swing of claim 9, wherein said upper portion of said support frame includes a plurality of cross members.

11. The portable lawn swing of claim 10, wherein said support frame is constructed of metal.

* * * * *